US010438763B2

(12) United States Patent
Lee

(10) Patent No.: US 10,438,763 B2
(45) Date of Patent: Oct. 8, 2019

(54) MAGNETIC TRIP DEVICE OF AIR CIRCUIT BREAKER

(71) Applicant: LSIS CO., LTD., Anyang-si, Gyeonggi-do (KR)

(72) Inventor: Kyu-Ho Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 72 days.

(21) Appl. No.: 15/946,378

(22) Filed: Apr. 5, 2018

(65) Prior Publication Data

US 2018/0308652 A1 Oct. 25, 2018

(30) Foreign Application Priority Data

Apr. 20, 2017 (KR) ..... 10-2017-0051245

(51) Int. Cl.

| | |
|---|---|
| ***H01H 71/10*** | (2006.01) |
| ***H01H 71/46*** | (2006.01) |
| ***H01H 71/50*** | (2006.01) |
| ***H01H 71/58*** | (2006.01) |
| ***H01H 50/44*** | (2006.01) |
| ***H01H 50/64*** | (2006.01) |

(52) U.S. Cl.

CPC ..... *H01H 71/1009* (2013.01); *H01H 50/44* (2013.01); *H01H 50/64* (2013.01); *H01H 71/10* (2013.01); *H01H 71/46* (2013.01); *H01H 71/505* (2013.01); *H01H 71/58* (2013.01); *H01H 2221/052* (2013.01)

(58) Field of Classification Search

CPC .... H01H 71/1009; H01H 50/44; H01H 50/64; H01H 71/10; H01H 71/46; H01H 71/505; H01H 71/58; H01H 2221/052

See application file for complete search history.

(56) References Cited

U.S. PATENT DOCUMENTS

| | | | | |
|---|---|---|---|---|
| 2,852,638 | A * | 9/1958 | Stramowski | H01H 75/04 335/29 |
| 4,001,739 | A | 1/1977 | Powell et al. | |
| 4,342,974 | A * | 8/1982 | Nakano | H01H 71/1009 335/10 |
| 2002/0088696 | A1* | 7/2002 | Ulerich | H01H 71/04 200/308 |
| 2015/0123751 | A1 | 5/2015 | Lee et al. | |

FOREIGN PATENT DOCUMENTS

| | | | |
|---|---|---|---|
| CN | 102376498 | A | 3/2012 |
| CN | 104040660 | A | 9/2014 |
| CN | 106449302 | A | 2/2017 |
| KR | 100854387 | B1 | 9/2008 |
| KR | 100876408 | B1 | 12/2008 |
| KR | 20150052646 | A | 5/2015 |
| KR | 20160133598 | A | 11/2016 |

OTHER PUBLICATIONS

Chinese Office Action for related Chinese Application No. 201810348649.0; action dated Mar. 25, 2019; (6 pages).

European Search Report for related European Application No. 18165624.0; action dated Sep. 20, 2018; (5 pages).

* cited by examiner

*Primary Examiner* — Mohamad A Musleh

(74) *Attorney, Agent, or Firm* — K&L Gates LLP

(57) ABSTRACT

Disclosed herein is a magnetic trip device. The magnetic trip device maintains a failure state indication through a latch, a lever, and a trip bar which are provided in the magnetic trip device and thus a switching part can be operated or maintained with a more simplified structure.

9 Claims, 14 Drawing Sheets

[Fig. 1]
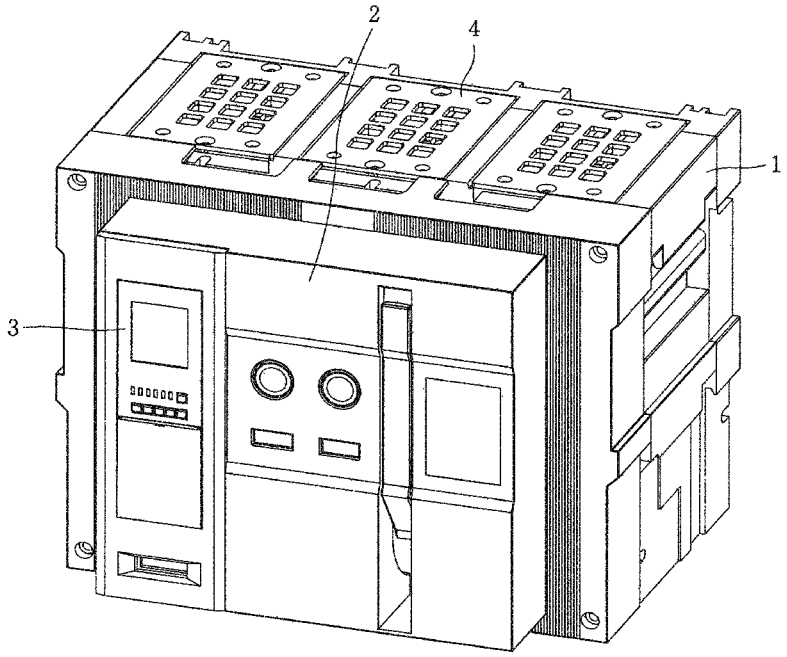

[Fig. 2]
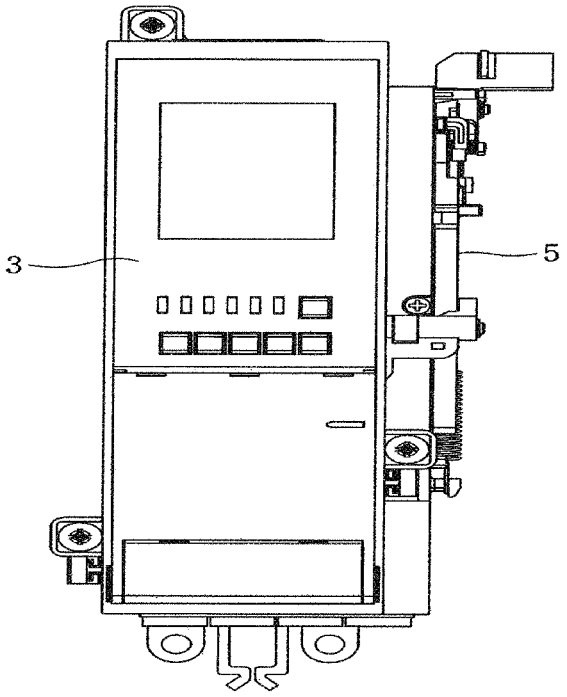

[Fig. 3]
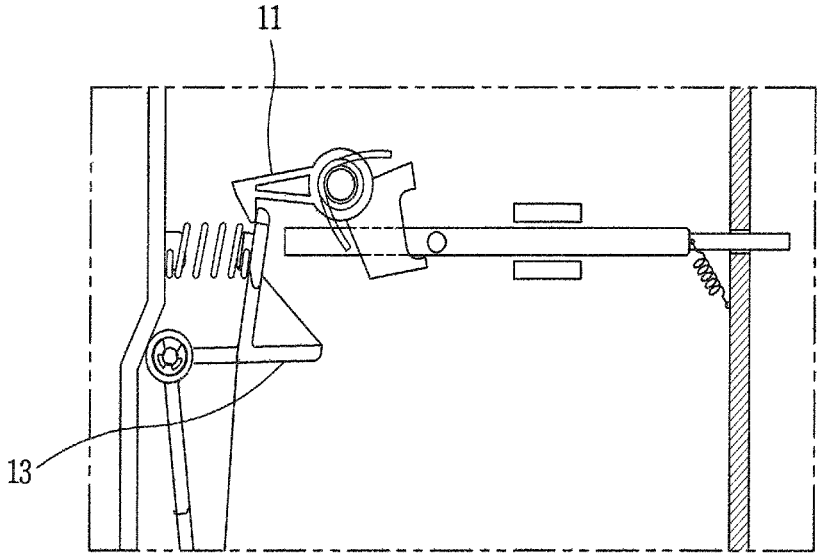

[Fig. 4]
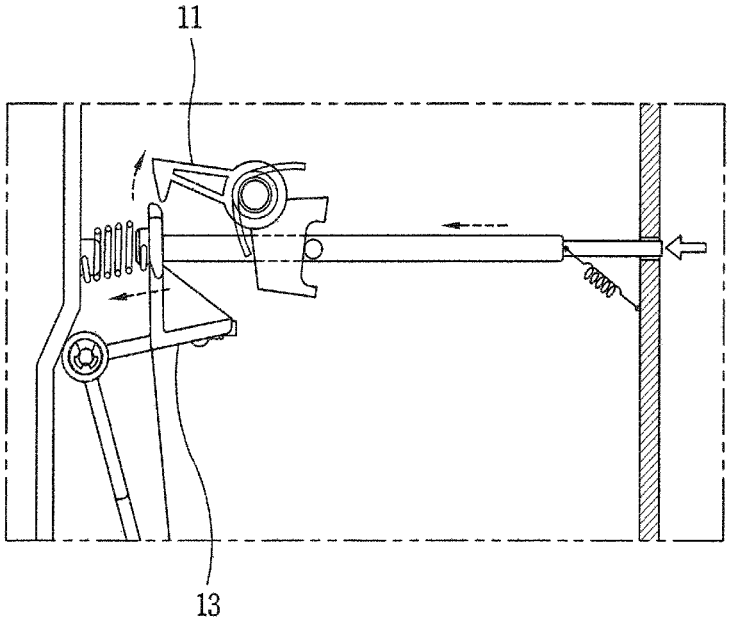

[Fig. 5]
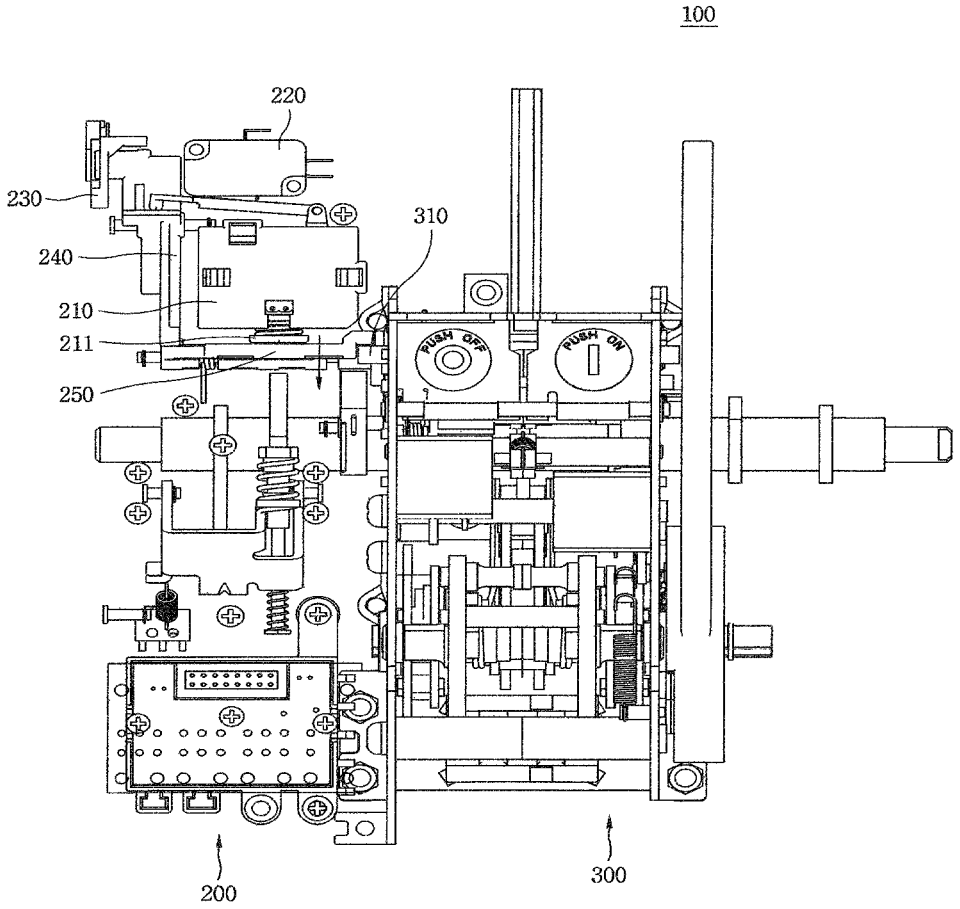

[Fig. 6]
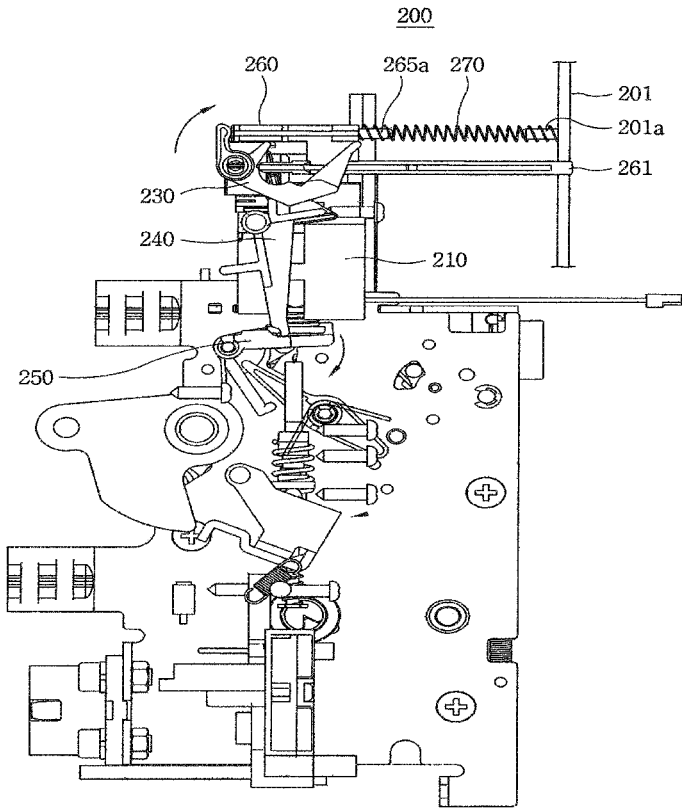

[Fig. 7]
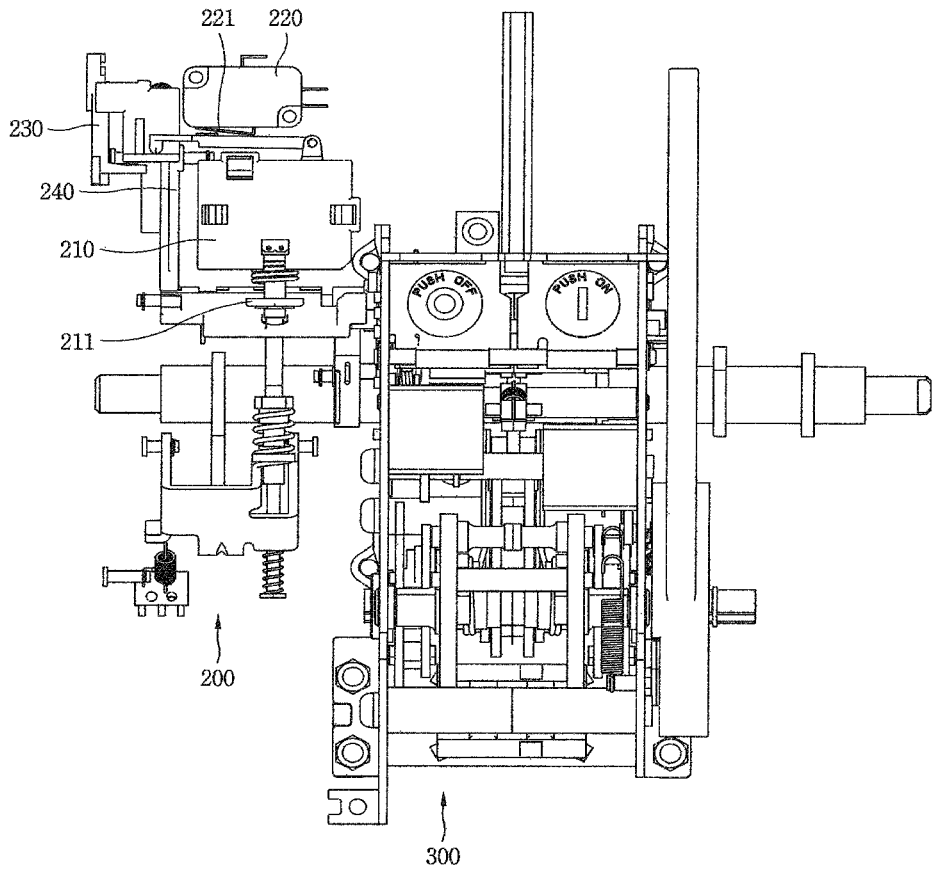

[Fig. 8]
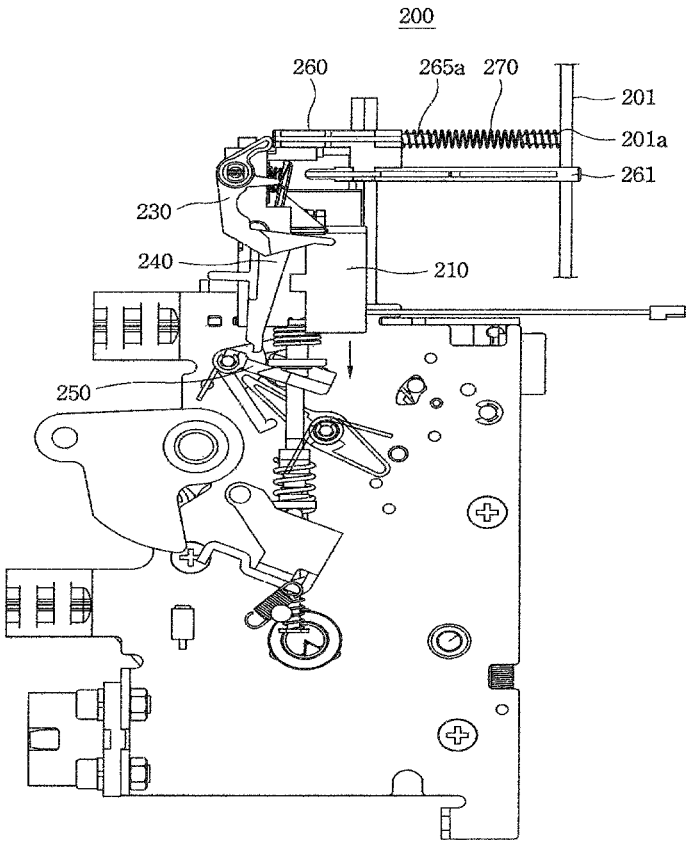

[Fig. 9]
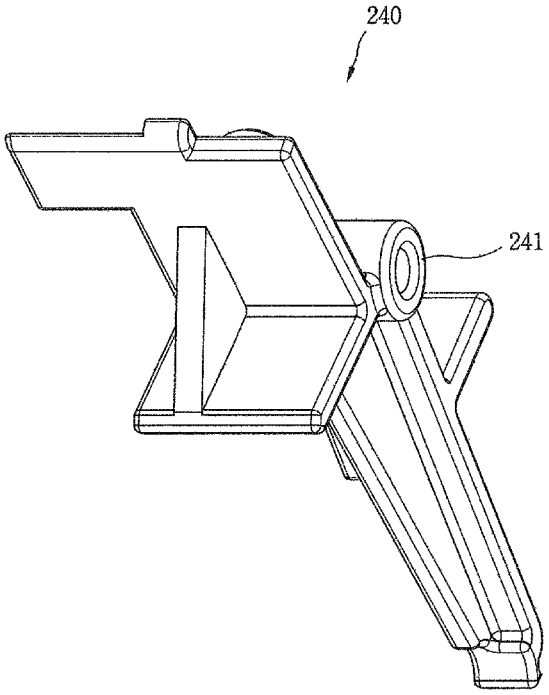

[Fig. 10]
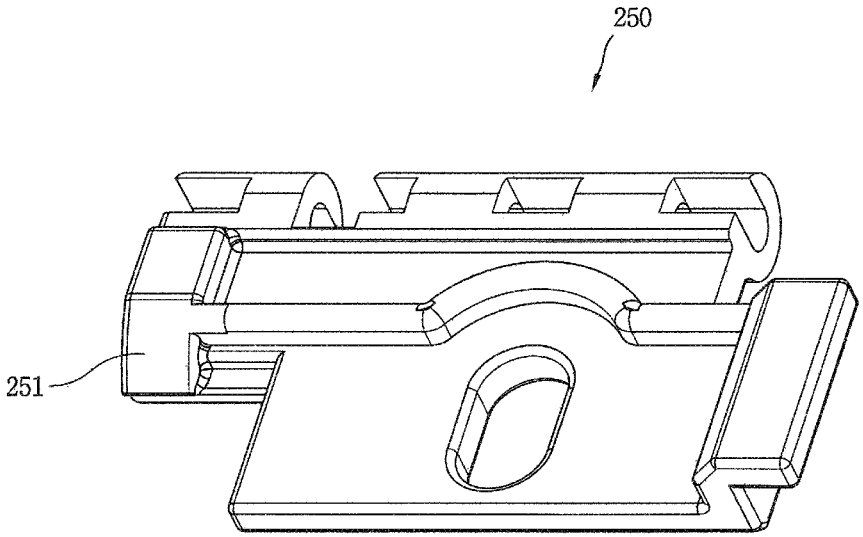

[Fig. 11]
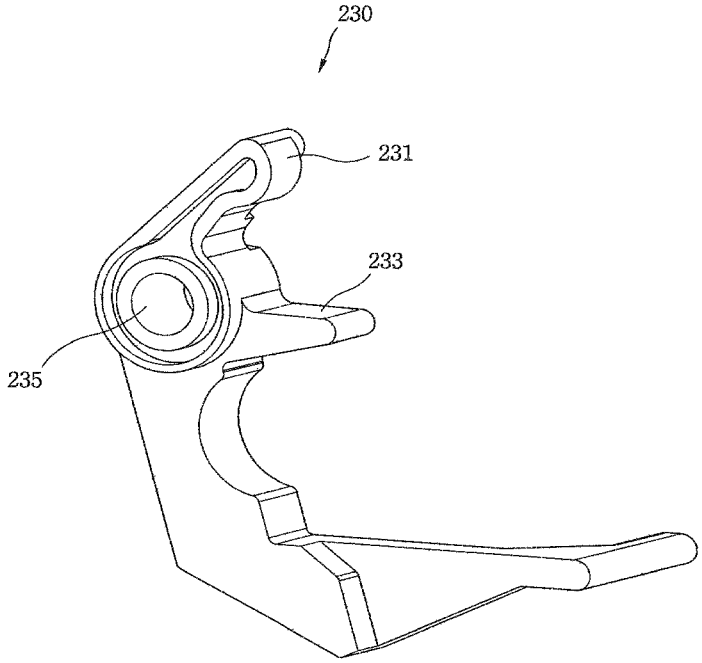

[Fig. 12]
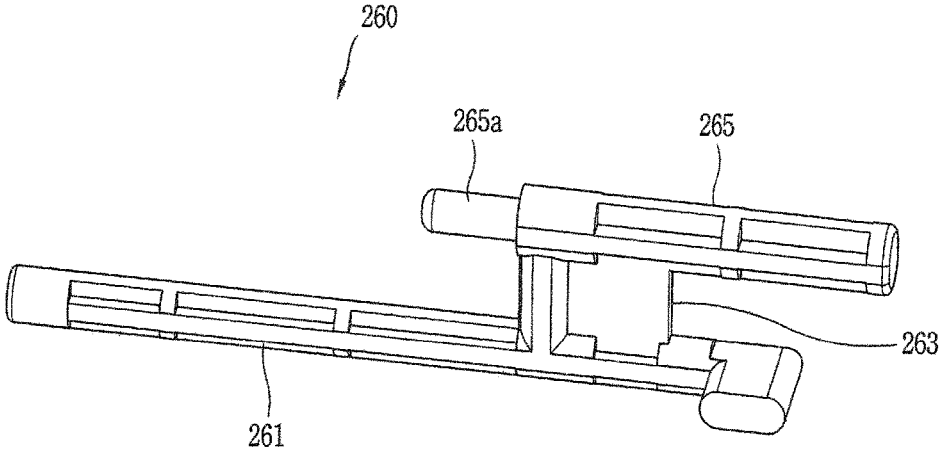

[Fig. 13]
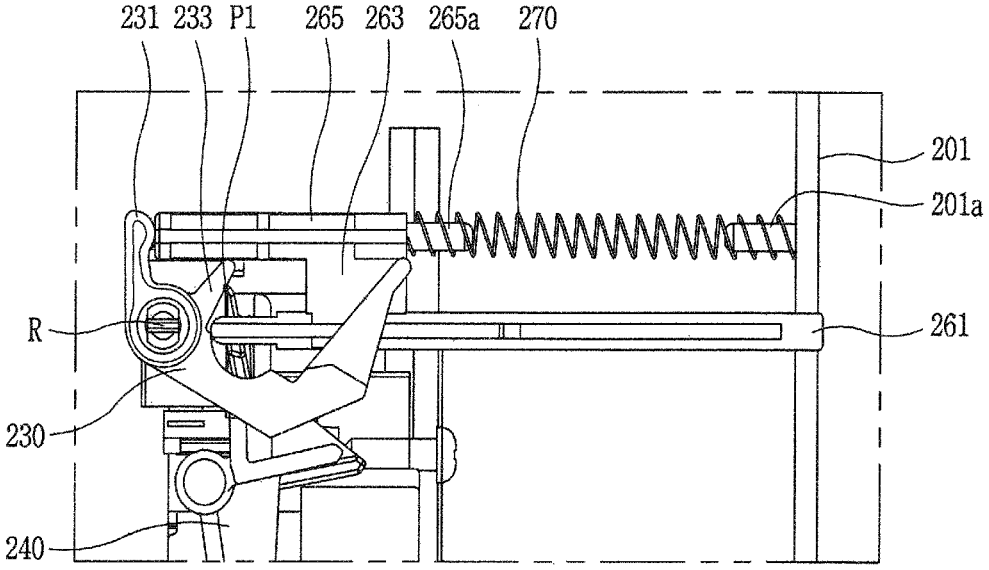

[Fig. 14]
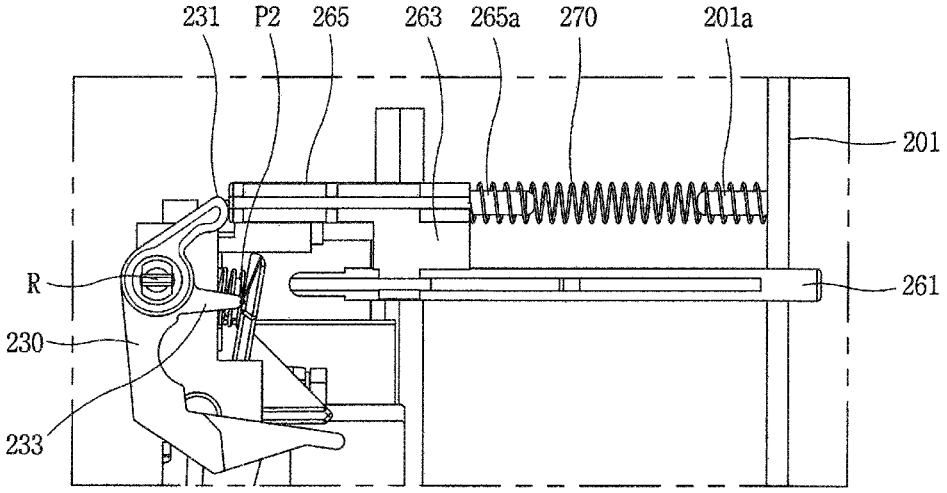

MAGNETIC TRIP DEVICE OF AIR CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2017-0051245, filed on Apr. 20, 2017, the disclosure of which is incorporated herein by reference in its entirety.

BACKGROUND

1. Field of the Invention

The present invention relates to a magnetic trip device of an air circuit breaker capable of maintaining a failure state indication without an error until an accident causation such as an inflow of a fault current or the like is removed.

2. Discussion of Related Art

Generally, air circuit breakers are kinds of circuit breakers which are installed at a power transmission site, a power substation, or an electrical circuit to block a current when a load is opened or closed, the ground is performed, or an accident such as a short circuit or the like occurs. Air circuit breakers are mainly used for low voltage equipment.

An air circuit breaker includes a switching mechanism configured to switch a fixed contact and a movable contact, an overcurrent relay configured to output a trip command for detecting a fault current and blocking an inflow of a large current, and an magnetic trip device disposed between the switching mechanism and the overcurrent relay and configured to generate a mechanical operation force and transfer the mechanical operation force to the switching mechanism.

FIG. 1 is a perspective view of a conventional air circuit breaker, and FIG. 2 is a front view illustrating an overcurrent relay provided in the conventional air circuit breaker and a magnetic trip device connected to the overcurrent relay.

As shown in FIGS. 1 and 2, the air circuit breaker includes a main body 1 forming an accommodation space therein, and a cover 2 coupled to a front surface of the main body 1.

A fixed contact (not shown) and a movable contact (not shown), to which a bus and a load are connected, and a switching mechanism configured to switch the fixed contact and the movable contact are accommodated and installed inside the main body 1.

Further, an arc extinguisher 4 is provided at a top of the main body 1 to discharge an arc generated when the fixed contact and the movable contact are separated.

Furthermore, an overcurrent relay 3 is provided at the front surface of the main body 1 to detect a fault current or an overcurrent and a case when a current having a predetermined value or more flows in and to block an inflow of the current. An opening is formed at the cover 2 to expose a front surface of the overcurrent relay 3.

The overcurrent relay 3 performs an important function of detecting a fault current and outputting a trip command, and thus a periodic inspection and replacement are required for the overcurrent relay 3.

Further, when the overcurrent relay 3 is separated for inspection or replacement thereof, since the function of detecting occurrence of a fault current and generating a trip command cannot be performed, the separation is performed in a state in which a trip button is pressed and thus a switching mechanism performs a trip operation.

Meanwhile, the overcurrent relay 3 is assembled with a magnetic trip device 5, and when the overcurrent relay 3 detects an overcurrent or a fault current, the overcurrent relay 3 transmits a trip command to the magnetic trip device 5.

At this point, the switching mechanism performs an input (ON) operation for current conduction or a trip (OFF) operation for current interruption by the magnetic trip device 5.

That is, the overcurrent relay 3 is used to detect an overcurrent and a fault current of an air circuit breaker, and the magnetic trip device 5 operates the switching mechanism according to a command transmitted from the overcurrent relay 3 to trip (OFF) the air circuit breaker.

However, the above-described conventional air circuit breaker is not provided with a device capable of indicating a failure state to the outside until a user releases the air circuit breaker after the trip operation is completed and then an accident causation is removed. Therefore, when the air circuit breaker is controlled to be in an input state before the user removes the accident causation, there is a problem in that a probability of an accident being generated is high.

As a solution to resolve the above-described problem, FIG. 3 is a partially enlarged view illustrating a state in which, when a fault current flows in, a magnetic trip device indicates a failure state to the outside and maintains the indication of the failure state using a hook member and a lever provided at a conventional air circuit breaker. FIG. 4 is a partially enlarged view illustrating a state in which the fault current is removed from the magnetic trip device provided at the conventional air circuit breaker and the magnetic trip device is reset.

As shown in FIGS. 3 and 4, the magnetic trip device of the conventional air circuit breaker is configured such that a hook member 11 is hooked to a lever 13 to maintain a failure status indication. However, such a configuration has a problem in that a structure is complicated and a probability of an error occurring is high during operation.

SUMMARY OF THE INVENTION

The present invention is directed to a magnetic trip device of an air circuit breaker, which is capable of maintaining a failure state indication without an error until an accident causation such as an inflow of a fault current is removed.

According to an aspect of the present invention, there is provided a magnetic trip device of an air circuit breaker, which includes a switching part operated by an actuator coil to indicate a failure state of the air circuit breaker when a fault current flows in, the magnetic trip device including a trip bar, which is configured to be in contact with a lower end of a lever and restrict the lever, to be moved by the actuator coil in a state in which the fault current flows in, and to move the lever to a position indicating a failure state, the lever having an upper portion located to be in contact with a latch and a lower portion to be in contact with the trip bar and configured to be restricted in pivoting of the lever by the trip bar in a steady state, to be pivoted to a position of indicating the failure state by the latch in the state in which the fault current flows in, and to operate the switching part, the latch located to be in contact with the upper portion of the lever, configured to be restricted in pivoting of the latch by the lever in the steady state and pivot the lever so as to allow the lever to operate the switching part in the state in which the fault current flows in, and, simultaneously, prevent the lever from returning to a position in the steady state, and a reset member located to be in contact with the latch, configured to be moved to a reset position so as to pivot the latch to a position in the steady state when the fault current is removed, and to be moved to a reset release position according to the pivoting of the latch.

A pressurizing part may be formed to protrude toward the lever at the latch and the lever may be pivoted by the pressurizing part.

A front end of the pressurizing part may be formed to be rounded.

A head part may be formed at an upper portion of the latch and be in contact with the reset member to be pivoted according to a movement of the reset member or to move the reset member to the reset release position.

A contact point between the pressurizing part and the lever may be located above a rotation center of the latch in the steady state such that the latch may be located in a state of having been pivoted together with the lever, and the contact point between the pressurizing part and the lever may be located below the rotation center of the latch after the fault current flows in such that pivoting of the lever may be restricted by the latch to maintain a failure state indication.

An inclined part adjacent to a lower end of the lever may be formed at the trip bar such that the lower end of the lever may be brought into contact with the inclined part to restrict pivoting of the trip bar, and when the fault current flows in and thus the trip bar is pivoted downward by the coil part, the lever may be released from being contact with the inclined part to be pivoted to a position indicating a failure state.

The reset member may include a pressing part having one end located to protrude outside the magnetic trip device and configured to be moved according to a manipulation of a user, a connecting plate formed to extend upward from the pressing part, and a latch adjusting part integrally formed at the connecting plate, horizontally formed with the pressing part and configured to push the head part while being moved according to a movement of the pressing part to pivot the latch to a position in the steady state.

A width of one end of the latch adjusting part toward a direction of the latch may be larger than that of the head part.

A first elastic member fitting part into which one end of an elastic member is fitted may be formed at one end of the latch adjusting part, and a second elastic member fitting part into which the other end of the elastic member is inserted may be formed at a case of the magnetic trip device.

The magnetic trip device may further include an annular part formed at an outer circumferential surface of the first elastic member fitting part and configured to hook the elastic member.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of a conventional air circuit breaker;

FIG. 2 is a front view illustrating an overcurrent relay provided in the conventional air circuit breaker and a magnetic trip device connected to the overcurrent relay;

FIG. 3 is a partially enlarged view illustrating a state in which, when a fault current flows in, a magnetic trip device provided at a conventional air circuit breaker indicates a failure state to the outside;

FIG. 4 is a partially enlarged view illustrating a state in which the fault current is removed from the magnetic trip device provided at the conventional air circuit breaker and the magnetic trip device is reset;

FIG. 5 is a front view illustrating a magnetic trip device and a switching mechanism when an air circuit breaker according to the present invention is in a steady state;

FIG. 6 is a left side view illustrating the magnetic trip device and the switching mechanism when the air circuit breaker according to the present invention is in the steady state;

FIG. 7 is a front view illustrating the magnetic trip device and the switching mechanism when the air circuit breaker according to the present invention is in a state in which a fault current flows in;

FIG. 8 is a left side view illustrating the magnetic trip device and the switching mechanism when the air circuit breaker according to the present invention is in the state in which the fault current flows in;

FIG. 9 is a perspective view illustrating a lever provided at the magnetic trip device of the air circuit breaker according to the present invention;

FIG. 10 is a perspective view illustrating a trip bar provided at the magnetic trip device of the air circuit breaker according to the present invention;

FIG. 11 is a perspective view illustrating a latch provided at the magnetic trip device of the air circuit breaker according to the present invention;

FIG. 12 is a perspective view illustrating a reset member provided at the magnetic trip device of the air circuit breaker according to the present invention;

FIG. 13 is a partially enlarged view of the magnetic trip device when the air circuit breaker according to the present invention is in the steady state; and FIG. 14 is a partially enlarged view of the magnetic trip device when the air circuit breaker according to the present invention is in the state in which the fault current flows in.

DETAILED DESCRIPTION OF EXEMPLARY EMBODIMENTS

Hereinafter, a magnetic trip device of an air circuit breaker according to one embodiment of the present invention will be described in detail with reference to the accompanying drawings.

FIG. 5 is a front view illustrating a magnetic trip device and a switching mechanism when an air circuit breaker according to the present invention is in a steady state, FIG. 6 is a left side view illustrating the magnetic trip device and the switching mechanism when the air circuit breaker according to the present invention is in the steady state, FIG. 7 is a front view illustrating the magnetic trip device and the switching mechanism when the air circuit breaker according to the present invention is in a state in which a fault current flows in, and FIG. 8 is a left side view illustrating the magnetic trip device and the switching mechanism when the air circuit breaker according to the present invention is in the state in which the fault current flows in.

FIG. 9 is a perspective view illustrating a lever provided at the magnetic trip device of the air circuit breaker according to the present invention, FIG. 10 is a perspective view illustrating a trip bar provided at the magnetic trip device of the air circuit breaker according to the present invention, FIG. 11 is a perspective view illustrating a latch provided at the magnetic trip device of the air circuit breaker according to the present invention, and FIG. 12 is a perspective view illustrating a reset member provided at the magnetic trip device of the air circuit breaker according to the present invention.

Further, FIG. 13 is a partially enlarged view of the magnetic trip device when the air circuit breaker according to the present invention is in the steady state, and FIG. 14 is a partially enlarged view of the magnetic trip device when the air circuit breaker according to the present invention is in the state in which the fault current flows in.

As shown in FIGS. 5 to 8, an air circuit breaker 100 according to the present invention includes an overcurrent relay (not shown), a magnetic trip device 200, and a switching mechanism 300.

The overcurrent relay detects a fault current or an overcurrent and detects an inflow of a current when the current having a predetermined current value or more flows in the air circuit breaker 100. Thereafter, the overcurrent relay blocks the inflow of the current into the air circuit breaker 100 by adjusting the switching mechanism 300.

When detecting the fault current, the magnetic trip device 200 receives a trip command from the overcurrent relay and operates the switching mechanism 300 to adjust the air circuit breaker 100 to be in a tripped state.

The switching mechanism 300 is configured to perform an automatic blocking operation when the fault current flows in. A movable contact (not shown) and a fixed contact (not shown) are provided at the switching mechanism 300. When the fault current flows in, the switching mechanism 300 operates to bring the movable contact into contact with the fixed contact or separate the movable contact from the fixed contact according to an operation of the magnetic trip device 200.

Meanwhile, the magnetic trip device 200 includes an actuator coil 210, a drive plate 211 configured to be vertically moved when a fault current is detected in the actuator coil 210, a switching part 220 configured to transmit an electrical signal according to a pivoting of a lever 240, a latch 230 configured to restrict the pivoting of the lever 240, and the lever 240 and a trip bar 250 which are pivoted to operate the switching part 220.

The actuator coil 210 includes a coil configured to be magnetized or demagnetized according to whether a magnetization control signal is applied from the overcurrent relay, and the drive plate 211 configured to be moved to a forward position or a backward position according to magnetization or demagnetization of the coil.

When the fault current flows in the air circuit breaker 100, the drive plate 211 is moved downward to rotate the trip bar 250 and, simultaneously, pressurizes a trip lever 310 to operate the switching mechanism 300.

Accordingly, when the fault current flows in, the drive plate 211 pushes and pivots the trip bar 250 while being moved downward and, simultaneously, pressurizes the trip lever 310 to operate the switching mechanism 300.

An operation part 221 is provided to protrude to the outside at the switching part 220 to output an electrical signal according to whether a mechanical pressure is received. The switching part 220 outputs an electrical signal indicating a state of the air circuit breaker 100 according to whether the operation part 221 is pressurized.

For example, when a pressure applied to the operation part 221 is released, a circuit is connected from a power source to an output terminal while an internal contact interlocked with the operation part 221 is closed. Accordingly, an electrical signal of a predetermined voltage indicating that the fault current has flowed into the air circuit breaker 100 is output.

As shown in FIG. 9, the lever 240 is pivotably connected to an interior of the magnetic trip device 200 by a hinge 241, and when a fault current flows in, the lever 240 is pivoted to indicate a state in which the air circuit breaker 100 fails and pressurize the operation part 221. Accordingly, the lever 240 causes the switching part 220 to output an electrical signal indicating that the fault current has flowed into the air circuit breaker 100 to the outside.

The trip bar 250 is disposed to be in contact with a lower end of the lever 240. The trip bar 250 restricts a pivoting of the lever 240 in a steady state to locate the lever 240 at a steady state position. When a fault current flows in, the trip bar 250 is pivoted downward through the drive plate 211 to pivot the lever 240 in a clockwise direction to a certain degree.

At this point, as shown in FIG. 10, an inclined part 251 adjacent to the lower end of the lever 240 is formed at the trip bar 250. Since the lower end of the lever 240 is located to be in contact with the inclined part 251 when the air circuit breaker 100 is in the steady state, the pivoting of the lever 240 is restricted. When the fault current flows in, the trip bar 250 is pivoted in the clockwise direction by the drive plate 211 such that the close contact between the lever 240 and the inclined part 251 is released. Accordingly, the lever 240 is pivoted in the clockwise direction together with the latch 230 through an elastic force applied to the latch 230 and thus the switching part 220 is operated.

The latch 230 is pivotably connected to the interior of the magnetic trip device 200 by a hinge 235 and is disposed to be in contact with one end of an upper portion of the lever 240. The latch 230 is kept at a position in the steady state by the lever 240 before the fault current flows in, that is, in the steady state. When the fault current flows in, the latch 230 pivots the lever 240 to a position of a failure state indication at which point the switching part 220 is operated while being pivoted by receiving an elastic force of an elastic member (not shown), and simultaneously prevents the lever 240 from returning to a steady position.

At this point, as shown in FIG. 11, a pressurizing part 233 is formed to protrude toward the lever 240 at the latch 230, and thus the lever 240 is pivoted by being interlocked with the latch 230 by the pressurizing part 233.

Further, a front end of the pressurizing part 233 has a rounded shape, and thus, when the pressurizing part 233 pivots the lever 240 as the latch 230 is pivoted, abrasion of a contact portion is prevented.

Further, a head part 231 located to be in contact with a reset member 260 is also formed at an upper portion of the latch 230. The head part 231 is pivoted according to a movement of the reset member 260 or moves the reset member 260 to a reset release position.

The head part 231 is formed to protrude from the upper portion of the latch 230 toward the reset member 260 and is located to be in contact with the reset member 260 in the steady state. When a fault current flows in causing the latch 230 to be pivoted, the head part 231 pushes the reset member 260 to move to the reset release position.

The reset member 260 is located to be in contact with the head part 231 of the latch 230. When the fault current is removed, the reset member 260 is moved to the latch 230 according to a manipulation of a user and then is moved to a reset position at which the latch 230 is pivoted to the steady state position. When the fault current flows in, the reset member 260 is moved according to the pivoting of the latch 230 and is moved to the reset release position.

Meanwhile, when the magnetic trip device 200 is in the steady state, a contact point P1 between the pressurizing part 233 and the lever 240 is located above a rotation center R of the latch 230, and thus the latch 230 is located in a state in which the latch 230 has been pivoted in the counterclockwise direction together with the lever 240.

Further, after the fault current flows in, a contact point P2 between the pressurizing part 233 and the lever 240 is located below the rotation center R of the latch 230, and thus the pivoting of the lever 240 is restricted by the latch 230 so as not to return to the original position such that indication of a failure state through the switching part 220 is maintained.

More specifically, in the steady state, the pressurizing part 233 of the latch 230 and the lever 240 are located to be in contact with each other. At this point, the contact point P1 between the pressurizing part 233 and the lever 240 is located above the rotation center R of the latch 230. Accordingly, the latch 230 receives a force in the counterclockwise direction by the lever 240 to maintain the position in the steady state.

At this point, a force for pivoting the lever 240 is an elastic force of an elastic member (not shown) configured to allow the trip bar 250 to return to its original position. The elastic member may be constituted with a torsion spring or the like. When the elastic force of the elastic member is applied to the trip bar 250, the lever 240 is pivoted in the counterclockwise direction by the trip bar 250 to pivot the latch 230 in the counterclockwise direction.

Thereafter, when the fault current flows in, the latch 230 is pivoted in the clockwise direction through the elastic force of the elastic member (not shown). The lever 240 is pivoted in the clockwise direction as the latch 230 is pivoted, and thus the contact point between the pressurizing part 233 and the lever 240 is changed.

That is, in a state in which the fault current flows in, the contact position P1 between the pressurizing part 233 and the lever 240 is located below the rotation center R of the latch 230. Therefore, even when the lever 240 is pivoted in the counterclockwise direction, the pivoting of the lever 240 is restricted by the latch 230 such that the failure state indication of the switching part 220 is maintained through the lever 240.

Meanwhile, as shown in FIG. 12, the reset member 260 includes a pressing part 261, a connecting plate 263, and a latch adjusting part 265.

One end of the pressing part 261 is located to protrude outside the magnetic trip device 200 and is moved according to the manipulation of the user.

The connecting plate 263 is formed to extend upward from the pressing part 261 to interconnect the pressing part 261 and the latch adjusting part 265.

The latch adjusting part 265 is integrally formed with the connecting plate 263 and is horizontally formed with the pressing part 261. The latch adjusting part 265 pivots the latch 230 to the position of the steady state while being moved according to a movement of the pressing part 261.

At this point, a width of one end of the latch adjusting part 265 toward the latch 230 is formed to be larger than that of the head part 231.

Thus, when the user pushes the pressing part 261 to pivot the latch 230 through the latch adjusting part 265, the latch 230 is easily pivoted.

Further, a first elastic member fitting part 265*a* into which one end of the elastic member 270 is inserted is formed at one end of the latch adjusting part 265. A second elastic member fitting part 201*a* into which the other end of the elastic member 270 is inserted is formed at the case 201 of the magnetic trip device 200.

Thus, the one end of the elastic member 270 is fitted into the first elastic member fitting part 265*a*, and the other end thereof is fitted into the second elastic member fitting part 201*a*. Therefore, the elastic member 270 provides an elastic force to the reset member 260 in a state of being firmly fixed.

Further, an annular part (not shown) may further be formed at an outer circumferential surface of the first elastic member fitting part 265*a* to hook the elastic member 270. The elastic member 270 is more firmly fixedly mounted by the annular part.

Hereinafter, a process of maintaining a failure indication state by the magnetic trip device of the air circuit breaker according to one embodiment of the present invention will be described in detail with reference to the accompanying drawings.

First, as shown in FIG. 6, in the steady state before the fault current flows in, the inclined part 251 of the trip bar 250 and the lower end of the lever 240 are in close contact with each other and thus the pivoting of the lever 240 is restricted.

At this point, the latch 230 receives the elastic force from the elastic member in the clockwise direction, and the lever 240 also receives a pivoting force in the clockwise direction.

Thereafter, as shown in FIG. 8, when the fault current flows in and the air circuit breaker 100 begins a cut-off operation, a trip signal is transmitted to the magnetic trip device 200. The drive plate 211 of the actuator coil 210 provided at the magnetic trip device 200 is moved downward by the trip signal and thus the trip bar 250 is pivoted in the clockwise direction to a predetermined angle.

Further, the trip bar 250 is pivoted and thus a contact between the lower end of the lever 240 and the inclined part 251 is released. Accordingly, both the latch 230 and the lever 240 are pivoted to have a maximum pivot angle in the clockwise direction by an elastic force pushing the latch 230.

At this point, when the latch 230 is pivoted, the head part 231 formed at the latch 230 pushes the reset member 260 to move to the reset release position.

Simultaneously, the lever 240 is pivoted in the clockwise direction together with the latch 230 to pressurize the operation part 221 of the switching part 220, such that an electrical signal indicating an inflow of the fault current is represented to the outside by the switching part 220.

Further, when the lever 240 has been pivoted to the maximum pivot angle, the elastic force of the elastic member provided below the trip bar 250 is applied to pivot the trip bar 250 in the counterclockwise direction. Consequently, the lever 240 is also pivoted in the counterclockwise direction to receive a force for returning to its original position. However, since the contact point P2 between the pressurizing part 233 formed at the latch 230 and the lever 240 is changed and now located below the rotation center R of the latch 230, the latch 230 prevents the lever 240 from returning to its original position. Thus, the indication of the failure state through the switching part 220 is maintained until an accident causation such as the inflow of the fault current is removed.

That is, in the steady state before the fault current flows in, the contact point P1 between the pressurizing part 233 and the lever 240 is located above the rotation center R of the latch 230, and thus the latch 230 is also located in a state of having been pivoted in the counterclockwise direction together with the lever 240. However, when the fault current flows in and the lever 240 is pivoted together with the latch 230 in the clockwise direction, the contact point P2 between the pressurizing part 233 and the lever 240 is located below the rotation center R of the latch 230. Thus, even when the lever 240 receives a force for returning to its original position, the pivoting of the lever 240 is restricted by the latch 230.

Meanwhile, when the user presses the reset member 260 after the accident causation such as the inflow of the fault current is removed, the latch 230 is pivoted in the counterclockwise direction by the reset member 260. Consequently, the restriction for preventing the pivoting of the lever 240 is released by the latch 230 and thus the lever 240 is pivoted in the counterclockwise direction to return to its original position by an elastic force of the torsion spring pushing the trip bar 250. At the same time, the trip bar 250 is also pivoted in the counterclockwise direction to return to its original position.

According to the present invention configured as described above, the latch 230, the lever 240, and the trip bar 250 are provided at the magnetic trip device 200, and thus there is an effect in that the failure state indication of the air circuit breaker 100 can be maintained in a more simplified structure.

Further, the head part 231 is formed at the latch 230 toward the reset member 260 and the reset member 260 pushes the head part 231 to pivot the latch 230, and thus the pivoting of the latch 230 through the reset member 260 becomes smoother.

Furthermore, the latch 230 is provided with the pressurizing part 233 having one end in a rounded shape, and the lever 240 is pivoted by the pressurizing part 233 according to the pivoting of the latch 230. Accordingly, with the more simplified structure, the lever 240 is smoothly pivoted, and at the same time, abrasion of the contact point is prevented when the pressurizing part 233 pivots the lever 240.

Further, the contact point between the pressurizing part 233 and the lever 240 is located above the rotation center of the latch 230 in the steady state, and in a state in which the failure state is indicated to the outside when the fault current flows in, the contact point between the pressurizing part 233 and the lever 240 is located below the rotation center of the latch 230. Therefore, in the state in which the failure state is indicated to the outside, the pivoting of the lever 240 is restricted by the latch 230, such that the indication of the failure state is maintained by the simplified structure.

Further, the width of one end of the latch adjusting part 265 toward the latch 230 is formed to be larger than that of the head part 231, such that the pivoting of the latch 230 can be performed without malfunction by the reset member 260.

Furthermore, since the one end of the elastic member 270 is fitted into the one end of the latch adjusting part 265 and the other end of the elastic member 270 is fitted into the case 201 of the magnetic trip device 200, the elastic force is provided to the reset member 260 in a state in which the elastic member 270, such as a spring, is firmly fixed.

In addition, since the annular part is formed at the outer circumferential surface of the first elastic member fitting part 265*a* to hook the elastic member 270, the elastic member 270 is firmly fixed to the first elastic member fitting part 265*a* by the annular part.

As described above, a magnetic trip device of an air circuit breaker according to the present invention maintains the failure state indication by a latch, a lever, and a trip bar provided in the electronic trip device, so that a switching part can be operated or a state of the switching part can be maintained with a simplified structure.

Further, a head part is formed at the latch and the latch is pivoted by a reset member, such that there is an advantage in that a pivoting of the latch becomes smoother through the reset member.

Furthermore, a pressurizing part is provided at the latch and the lever is pivoted by the pressurizing part according the pivoting of the latch, such that there is an effect of allowing the lever to be smoothly pivoted with a more simplified structure.

In a steady state, a contact point between the pressurizing part and the lever is located above a rotation center of the latch, and in a state in which a fault current flows in and thus a failure state is indicated to the outside, the contact point between the pressurizing part and the lever is located below the rotation center of the latch and the pivoting of the lever is restricted, such that there is an effect of indicating the failure state to the outside with the simplified structure.

Further, a width of one end of a latch adjusting portion toward a direction of the latch is formed to be larger than that of the head part, such that there is an effect in that the pivoting of the latch by the reset member can be performed without malfunction.

Furthermore, a first elastic member fitting part is formed and thus one end of an elastic member is fitted into one end of the latch adjusting portion and a second elastic member fitting part is formed and thus the other end of the elastic member is fitted into a case of the magnetic trip device, such that there is an effect of providing an elastic force to the reset member in a state in which the elastic member such as a spring is firmly fixed.

In addition, an annular part is formed at an outer circumferential surface of the first elastic member fitting part to hook the elastic member, such that there is an effect in that the elastic member is firmly fixed to the first elastic member fitting part by the annular part.

While the preferred embodiments of the present invention have been described, it is noted that various alternations, modifications, and equivalents can be applied to the present invention and the preferred embodiments can be appropriately modified and applied thereto. Therefore, the above description is not intended to limit the scope of the present invention defined by the appended claims.

What is claimed is:

1. A magnetic trip device of an air circuit breaker, which includes a switching part operated by an actuator coil to indicate a failure state of the air circuit breaker when a fault current flows in to the magnetic trip device, the magnetic trip device comprising:

a trip bar configured to:

be in contact with a lower end of a lever, restrict pivoting of the lever in a steady state, and be moved by the actuator coil in a state in which the fault current flows in to the magnetic trip device to move the lever to a position indicating a failure state;

the lever having an upper portion in contact with a latch, and configured to:

be pivoted to a position of indicating the failure state by the latch in the state in which the fault current flows in to the magnetic trip device, restrict pivoting of the latch in the steady state, and operate the switching part;

the latch in contact with the upper portion of the lever, and configured to pivot the lever so as to allow the lever to operate the switching part in the state in which the fault current flows in to the magnetic trip device and, simultaneously, prevent the lever from returning to a position in the steady state; and a reset member in contact with the latch, and configured to be moved to a reset position so as to pivot the latch to a position in the steady state when the fault current is removed, and to be moved to a reset release position according to the pivoting of the latch, wherein a head part is formed at an upper portion of the latch and is in contact with the reset member to be pivoted according to a movement of the reset member or to move the reset member to the reset release position.

2. The magnetic trip device of claim 1, wherein a pressurizing part is formed to protrude toward the lever at the latch and the lever is pivoted by the pressurizing part.

3. The magnetic trip device of claim 2, wherein a front end of the pressurizing part is formed to be rounded.

4. The magnetic trip device of claim 2, wherein:

a contact point between the pressurizing part and the lever is located above a rotation center of the latch in the steady state such that the latch is located in a state of having been pivoted together with the lever, and the contact point between the pressurizing part and the lever is located below the rotation center of the latch after the fault current flows in to the magnetic trip device such that pivoting of the lever is restricted by the latch to maintain the indication of the failure state.

5. The magnetic trip device of claim 1, wherein:

an inclined part adjacent to the lower end of the lever is formed at the trip bar such that the lower end of the lever is brought into contact with the inclined part to restrict pivoting of the trip bar, and when the fault current flows in to the magnetic trip device and thus the trip bar is pivoted downward by the actuator coil, the contact between the lever and the inclined part is released and the lever is pivoted to the position of indicating the failure state.

6. The magnetic trip device of one of claim 1, wherein the reset member includes:

a pressing part having one end located to protrude outside the magnetic trip device and configured to be moved according to a manipulation of a user;

a connecting plate formed to extend upward from the pressing part; and a latch adjusting part integrally formed at the connecting plate, horizontally formed with the pressing part and configured to push the head part while being moved according to a movement of the pressing part to pivot the latch to a position in the steady state.

7. The magnetic trip device of claim 6, wherein a width of one end of the latch adjusting part toward a direction of the latch is larger than that of the head part.

8. The magnetic trip device of claim 6, wherein:

a first elastic member fitting part into which one end of an elastic member is fitted is formed at one end of the latch adjusting part, and a second elastic member fitting part into which the other end of the elastic member is inserted is formed at a case of the magnetic trip device.

9. The magnetic trip device of claim 8, further comprising an annular part formed at an outer circumferential surface of the first elastic member fitting part and configured to hook the elastic member.

* * * * *